US011311444B2

(12) United States Patent
Jamesapollos

(10) Patent No.: US 11,311,444 B2
(45) Date of Patent: Apr. 26, 2022

(54) ASSISTIVE STRETCHING DEVICE AND METHOD OF USE

(71) Applicant: John Jamesapollos, Bedford, MA (US)

(72) Inventor: John Jamesapollos, Bedford, MA (US)

(73) Assignee: WE IP, LLC, Brooklyn, MA (US)

( * ) Notice: Subject to any disclaimer, the term of this patent is extended or adjusted under 35 U.S.C. 154(b) by 29 days.

(21) Appl. No.: 16/914,241

(22) Filed: Jun. 26, 2020

(65) Prior Publication Data

US 2020/0390634 A1 Dec. 17, 2020

Related U.S. Application Data

(63) Continuation-in-part of application No. 16/571,849, filed on Sep. 16, 2019, now Pat. No. 11,103,409,
(Continued)

(51) Int. Cl.
*A61H 1/02* (2006.01)
*A63B 23/02* (2006.01)
(Continued)

(52) U.S. Cl.
CPC ..... *A61H 1/0244* (2013.01); *A61H 1/02* (2013.01); *A61H 1/0218* (2013.01);
(Continued)

(58) Field of Classification Search
CPC .. A61H 1/0244; A61H 1/0237; A61H 1/0292; A61H 1/0218; A61H 1/02;
(Continued)

(56) References Cited

U.S. PATENT DOCUMENTS 2,777,439 A 1/1957 Tuttle
3,724,450 A 4/1973 Chaitin
(Continued)

FOREIGN PATENT DOCUMENTS

FR 3001382 B1 4/2016
WO 2003092824 A1 11/2003
WO 2014195373 A1 12/2014

OTHER PUBLICATIONS

Brook Benton, 6 Stretches You Must Do If You're Stuck Sitting All Day, Prevention, Sep. 15, 2015, retrieved from https://www.prevention.com/fitness/a20480347/6-best-body-stretches-if-you-sit-all-day/ on Jan. 26, 2021.

(Continued)

*Primary Examiner* — Andrew S Lo
(74) *Attorney, Agent, or Firm* — McInnes & McLane, LLP

(57) ABSTRACT

An assistive stretching device worn by a user to reduce physical stress while lifting to aid another individual in stretching and method is disclosed. The device includes a belt sized to fit around the torso of the user, first and second pulleys supported on the belt, first and second wrist attachments; first and second ankle attachments; first and second cords threaded through corresponding pulleys with one end attached to corresponding ankle attachments and the opposite end attached to corresponding wrist attachments. The pulleys operate to change the direction of the lifting force, making it easier to lift and stretch the anterior aspects of the musculature of the individual rather than lifting dead weight. An attachment including a dual pulley system may replace the first and second pulleys and includes an arm supporting a pulley at each end and openings to provide leverage adjustments when attaching the arm to the belt.

16 Claims, 8 Drawing Sheets

Related U.S. Application Data which is a continuation of application No. 15/703,231, filed on Sep. 13, 2017, now Pat. No. 10,449,104.

(51) Int. Cl.
*A63B 23/04* (2006.01)
*A63B 23/035* (2006.01)
*A63B 23/00* (2006.01)

(52) U.S. Cl.
CPC ..... *A61H 1/0237* (2013.01); *A61H 1/0292* (2013.01); *A63B 23/0216* (2013.01); *A63B 23/0233* (2013.01); *A63B 23/03525* (2013.01); *A63B 23/04* (2013.01); *A61H 2201/0192* (2013.01); *A61H 2201/1238* (2013.01); *A61H 2201/1253* (2013.01); *A61H 2201/165* (2013.01); *A61H 2201/1642* (2013.01); *A61H 2201/1676* (2013.01); *A61H 2203/0468* (2013.01); *A61H 2205/08* (2013.01); *A61H 2205/088* (2013.01); *A61H 2205/10* (2013.01); *A63B 2023/006* (2013.01)

(58) Field of Classification Search
CPC .... A61H 2201/1676; A61H 2201/1642; A61H 2201/165; A61H 2201/1238; A61H 2201/1253; A61H 2205/10; A61H 2201/0192; A61H 2205/088; A61H 2205/08; A61H 2203/0468; A61H 1/00; A63B 23/0233; A63B 23/0216; A63B 23/04; A63B 23/03525; A63B 2023/006; A63B 21/068; A63B 21/4009; A63B 21/4021; A63B 21/4019; A63B 21/4013; A63B 21/154; A63B 21/285; A63B 2208/0257; A63B 2209/10; A63B 2225/093; A63B 2208/0223; A63B 2225/09

See application file for complete search history.

(56) References Cited

U.S. PATENT DOCUMENTS

| | | | | |
|---|---|---|---|---|
| 4,232,662 | A | 11/1980 | Barber | |
| 4,478,213 | A | 10/1984 | Redding | |
| 4,838,249 | A | 6/1989 | Jannotta | |
| 5,203,755 | A | 4/1993 | Kaiser | |
| 5,318,495 | A | 6/1994 | Malynowsky | |
| 5,449,336 | A | 9/1995 | Sabel | |
| 5,772,612 | A | 6/1998 | Ilan | |
| 6,261,250 | B1 | 7/2001 | Phillips | |
| 7,540,877 | B2 | 6/2009 | Emsky | |
| 7,553,266 | B2 | 6/2009 | Abdoli-Eramaki | |
| 8,784,284 | B1 | 7/2014 | Smith | |
| 9,919,177 | B2 | 3/2018 | Foster | |
| 10,207,140 | B2 | 2/2019 | Carriere, Jr. | |
| 10,220,251 | B2 | 3/2019 | Cullison | |
| 10,335,305 | B2 | 7/2019 | Petterson et al. | |
| 10,576,325 | B2 * | 3/2020 | Tedesco | A63B 21/0442 |
| 10,926,123 | B2 * | 2/2021 | Lear | A63B 21/00181 |
| 2002/0016240 | A1 | 2/2002 | Conner | |
| 2002/0183176 | A1 | 12/2002 | Read | |
| 2005/0049124 | A1 | 3/2005 | Xieh | |
| 2005/0130814 | A1 | 6/2005 | Nitta et al. | |
| 2005/0130815 | A1 * | 6/2005 | Abdoli-Eramaki | A61H 3/008 482/121 |
| 2005/0279791 | A1 | 12/2005 | Komorowski | |
| 2006/0229167 | A1 * | 10/2006 | Kram | A63B 21/00181 482/54 |
| 2008/0182730 | A1 | 7/2008 | Conley et al. | |
| 2009/0258767 | A1 | 10/2009 | Foucault | |
| 2009/0258768 | A1 * | 10/2009 | Clarke | A63B 23/03575 482/124 |
| 2009/0325768 | A1 | 12/2009 | Wessels et al. | |
| 2010/0049097 | A1 | 2/2010 | O'Brien et al. | |
| 2010/0216616 | A1 | 8/2010 | Jennings | |
| 2010/0279832 | A1 | 11/2010 | Conley et al. | |
| 2012/0018932 | A1 | 1/2012 | Fairbanks | |
| 2013/0045842 | A1 | 2/2013 | Wood | |
| 2013/0197410 | A1 | 8/2013 | Petterson et al. | |
| 2013/0225378 | A1 | 8/2013 | Burek | |
| 2014/0073496 | A1 | 3/2014 | Bannerman | |
| 2015/0314157 | A1 | 11/2015 | Lampert et al. | |
| 2015/0321339 | A1 * | 11/2015 | Asbeck | A61F 2/68 414/7 |
| 2017/0014666 | A1 | 1/2017 | Sather et al. | |
| 2017/0189748 | A1 | 7/2017 | Montgomery | |
| 2018/0021614 | A1 | 1/2018 | Taft et al. | |
| 2019/0125610 | A1 * | 5/2019 | Murakami | A61B 5/6831 |
| 2020/0155888 | A1 * | 5/2020 | Tedesco | A41D 1/04 |
| 2020/0155891 | A1 * | 5/2020 | Tedesco | A63B 21/04 |

OTHER PUBLICATIONS

Robin McKenzie, The McKenzie Method for Lower Back Pain Relief, spineone, Retrieved from https://www.spineone.com/mckenzie-method-back-pain/ on Jan. 26, 2021.

Kostabi et al., 8 Partner Stretches To Do, FitBottomedGirls, Jun. 8, 2015, Retrieved from https://fitbottomedgirls.com/2015/06/8-partner-stretches-to-do/ on Jan. 26, 2021.

Poise et al., Core Exercise & Stretches, Poise-Health, Retrieved from https://poise-health.co.uk/help-advice/basic-core-exercise-stretches/ on Jan. 26, 2021.

Kelly Collins, 7 Feel Good Partner Stretches For The Lower Back, Blog.paleohacks.com, Retrieved from https://blog.paleohacks.com/partner-stretches-for-lower-back-pain/# on Jan. 26, 2021.

Joan Miller, Simple Move For Back Health, Hudson Valley Parent, Retrieved from https://hvparent.com/ballbackstretch on Jan. 26, 2021.

* cited by examiner

ASSISTIVE STRETCHING DEVICE AND METHOD OF USE

RELATED APPLICATIONS

This patent claims priority as a continuation-in-part to U.S. application Ser. No. 16/571,849, filed on Sep. 16, 2019, which is currently pending, and claims priority as a continuation to U.S. application Ser. No. 15/703,231, filed on Sep. 13, 2017, now U.S. Pat. No. 10,449,104, all of the foregoing being incorporated here by reference in their entirety.

TECHNICAL FIELD

The present disclosure relates to a device used during stretching exercises provided by a user to reduce physical stress on the user when aiding another individual in re-balancing the body through assisted stretching. More particularly but not exclusively, to a harness having a pulley system with attachments near the user's ankles, hips and hands that together aid in reducing the physical stress on the user while enhancing stretching for the individual, for example to the anterior aspect of the musculature to properly balance the overuse often experienced to the posterior aspect of the musculature after prolonged or repetitive sitting or bending and to prevent unbalancing of the body in anticipation of stresses to the posterior aspect of the musculature or the individual.

BACKGROUND

A common deleterious effect from prolonged or repetitive sitting or repetitive bending is the differential effects on the person's body with respect to the anterior and posterior muscles and ligaments. It is well understood that prolonged or repetitive sitting leads to tighter, shorter anterior muscles and ligaments in a person's body and a concomitant, but opposite, effect on the posterior muscles and ligaments, which are lengthened and weakened. Other bending related activities of a repetitive or prolonged nature can cause a similar deleterious effect on a person's body because as muscles and ligaments around joints become imbalanced, posture and movement become affected leading to knee, hip, back, neck and shoulder pain. The most common causes of movement dysfunction and pain are muscular and ligamentous imbalance and subsequent joint irritation and altered function that proceeds from these imbalances.

Numerous methods and treatments have been devised to treat muscle and joint pain. For example, related patent, U.S. Pat. No. 10,449,104, is directed to a method and device to stretch the anterior muscles and ligaments. As disclosed in that invention, the person being stretched lays in the prone position and places his feet into the lower extremity attachment portion of the device. Once his feet are secured, a rotational member is lowered or raised along a vertical axis to change the height of the lower extremity attachment device with respect to the plane that the individual is lying creating a sustained and relaxing stretch to the anterior aspects of the musculature. The rotational member can also be rotated to increase the height of one leg respective to one another preferentially changing the effect of the stretch. The movement of the device with respect to the individual allows disparities in muscle, fascia or ligament tightness to be addressed and customized based on the individual's needs. Because of the size and weight of this device, it is not easily transported and takes up a large amount of space. As such, the locations where the stretches can be performed by the device and method are limited.

In physical therapy, a McKenzie approach uses press-up into extension whereby the person uses his or her arms to create a stretch to the anterior muscles and ligaments. While the McKenzie approach is quite effective, it does have several limitations. First, many people are unable to maintain a lack of tension in the body. Rather, the natural tendency is to use muscle tension to guard against the stretch, which essentially negates any positive stretching effect. In addition, many people's arms experience fatigue when attempting the McKenzie approach. This fatigue prevents sustained engagement of the stretching.

SUMMARY

Although an individual, such as a physical therapist, exercise coach, spouse, and so forth, can assist with the lifting and rotating of a stretching individual's body, this is not ideal. The weight of the stretching individual's body, the extended durations of the stretches (each stretch should be held for approximately 30 seconds), the numerous different stretches that need to be performed, and the numerous different individuals that need to be stretched, puts an enormous amount of physical stress on the physical therapist. Therefore, it is desirable to have a device and method that is compact and portable to reduce the physical stress on the user, like a physical therapist, when stretching the anterior muscles and ligaments of another individual.

The inventive device and methods disclosed herein assists a user in creating and sustaining a differential stretch to the anterior muscles and ligaments of the torso, hips and legs of an individual and provides reduced physical stress in the user while doing so. The anterior muscles in these regions tend to be tighter and shorter in individuals who sit for more than brief intervals of time. The device comprises a harness including a belt having a body sized to fit around the torso of the user, at least a first pulley and a second pulley supported on the belt, a first and a second wrist attachment sized to fit one of each of the user's wrists; a first and a second ankle attachment sized to fit one of each of the user's ankles; a first cord and a second cord threaded through corresponding first and second pulleys, each cord having one end attached to one of the ankle attachments and an opposite end attached to one of the wrist attachments, the first and second pulleys operating to reduce physical stress on the user as the user stretches the anterior aspect of the musculature of the individual. In one embodiment, an attachment including a dual pulley system has a leverage arm with multiple openings to provide adjustments to allow differing lifting forces to be applied and to allow for a better accommodation to users of different heights. This allows sufficient leverage when lifting of the individual's legs off the ground.

In methods of use, the device is used to lift an individual's legs off of the ground, while the person is lying face down, so as to create a stretch in the anterior muscles, fascia, or ligaments. The device allows the user to move the individual through various planes of sustained stretching with rotation, which allows for differential stretching in the various quadrants of the person's anterior aspects of their musculature.

BRIEF DESCRIPTION OF THE DRAWINGS

Various aspects of at least one embodiment are discussed below with reference to the accompanying figures, which are not necessarily drawn to scale, emphasis instead being placed upon illustrating the principles disclosed herein. The figures are included to provide an illustration and a further understanding of the various aspects and embodiments and are incorporated in and constitute a part of this specification but are not intended as a definition of the limits of any particular embodiment. The figures, together with the remainder of the specification, serve only to explain principles and operations of the described and claimed aspects and embodiments, but are not to be construed as limiting embodiments. In the figures, each identical or nearly identical component that is illustrated in various figures is represented by a like numeral. For purposes of clarity, not every component may be labeled in every figure.

DETAILED DESCRIPTION OF THE ILLUSTRATIVE EMBODIMENTS

The examples of the apparatus and method discussed herein are not limited in application to the details of construction and the arrangement of components set forth in the following description or illustrated in the accompanying drawings. It will be understood to one of skill in the art that the apparatus is capable of implementation in other embodiments and of being practiced or carried out in various ways. Examples of specific embodiments are provided herein for illustrative purposes only and are not intended to be limiting. Also, the phraseology and terminology used herein is for the purpose of description and should not be regarded as limiting. Any references to examples, embodiments, components, elements or acts of the apparatus and method herein referred to in the singular may also embrace embodiments including a plurality, and any references in plural to any embodiment, component, element or act herein may also embrace embodiments including only a singularity (or unitary structure). References in the singular or plural form are not intended to limit the presently disclosed apparatus, its components, acts, or elements. As used herein, the singular forms "a", "an" and "the" are intended to include the plural forms as well, unless the context clearly indicates otherwise. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Figure 1:
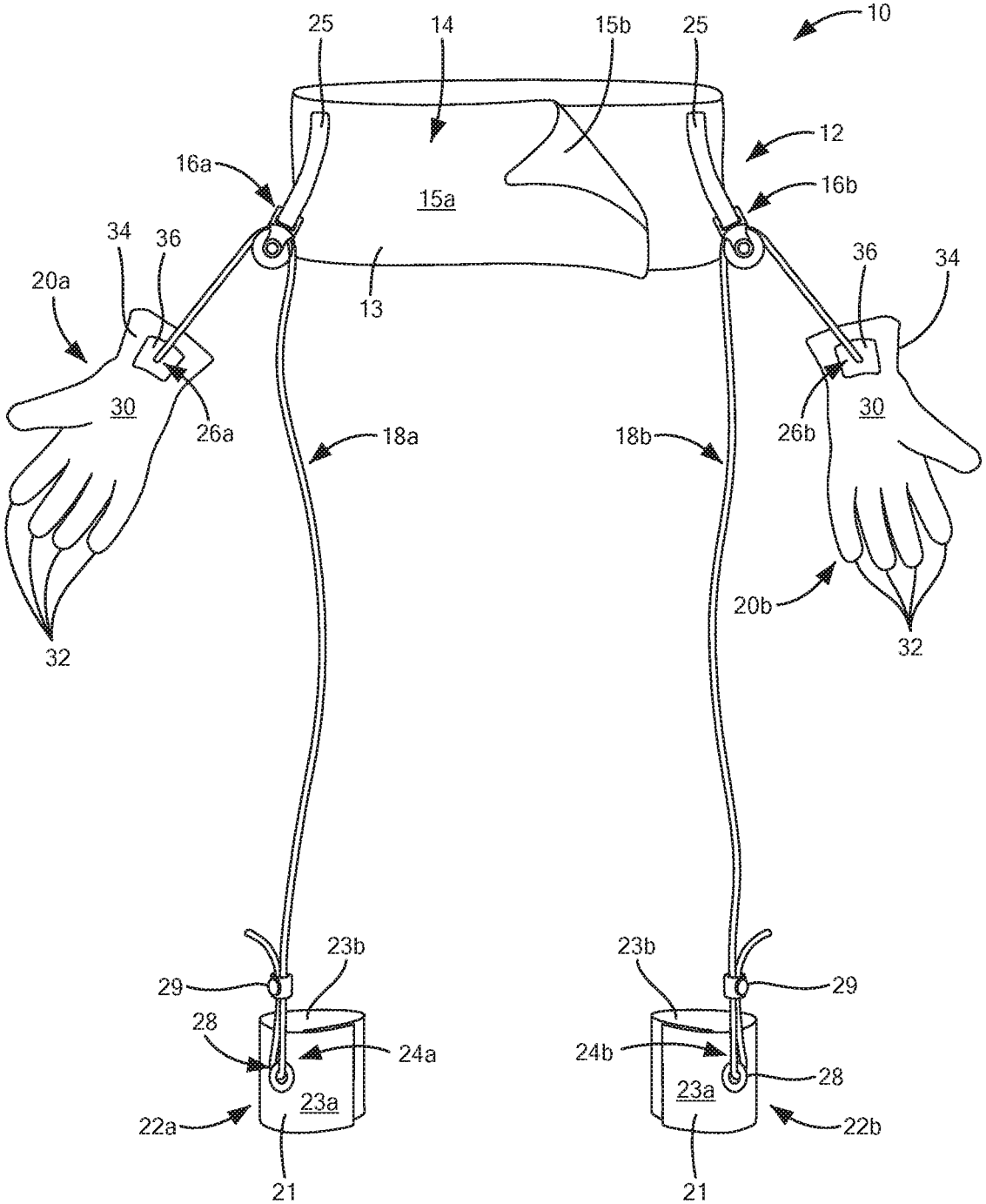
FIG. 1 is a front plan view of an assistive stretching device in accordance with a first embodiment of the present disclosure.

FIG. 1 illustrates an assistive stretching device 10 according to a first embodiment of the present disclosure described herein. In this embodiment the assistive stretching device 10 comprises a harness 12 having a belt 14 sized to fit around the torso of the user 9 (FIG. 1), for example a physical therapist, exercise coach, spouse, etc., and at least a first pulley 16*a* and a second pulley 16*b* supported on the belt 14. Each of the first and second pulleys 16*a*, 16*b* have a corresponding first and second cord 18*a*, 18*b* threaded therethrough. Harness 12 further includes a first and a second support attachment 20*a*, 20*b* constructed and arranged to fit one of each of the user's wrists and a first ankle attachment 22*a* and a second ankle attachment 22*b* constructed and arranged to fit one of each of the user's ankles. Each cord 18*a*, 18*b* includes a first end 24*a*, 24*b* and a second end 26*a*, 26*b*, opposite the first end, the cords 18*a*, 18*b* being threaded through corresponding first and second pulleys 16*a*, 16*b*, with one end 24*a*, 24*b* of each cord attached to a corresponding ankle attachment 22*a*, 22*b* and the opposite end 26*a*, 26*b* attached to one of the support attachments 20*a*, 20*b*. The first and second pulleys 16*a*, 16*b* operating to reduce physical stress on the user as the user stretches the anterior aspect of the musculature of an individual 11 by changing the direction of the lifting force and applying that force of the lift from the hands to the hips and legs, making it easier to lift the individual rather than lifting the dead weight of the individual by hand with the forces on the user going from the hands to the shoulders through the back hips, and to the legs.

Figure 2:
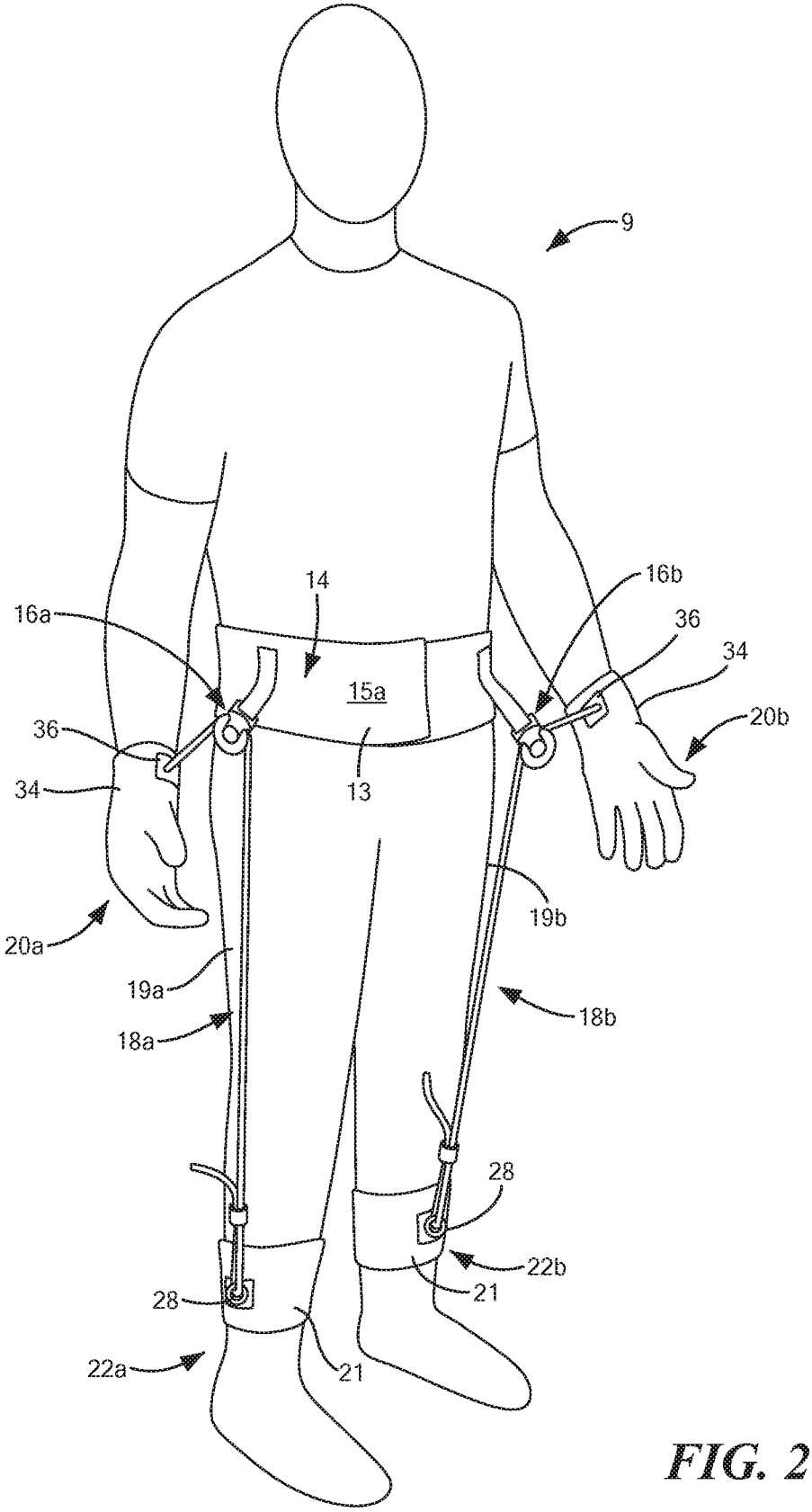
FIG. 2 is a front perspective view of the assistive stretching device of FIG. 1 as worn by a user.
Figure 5:
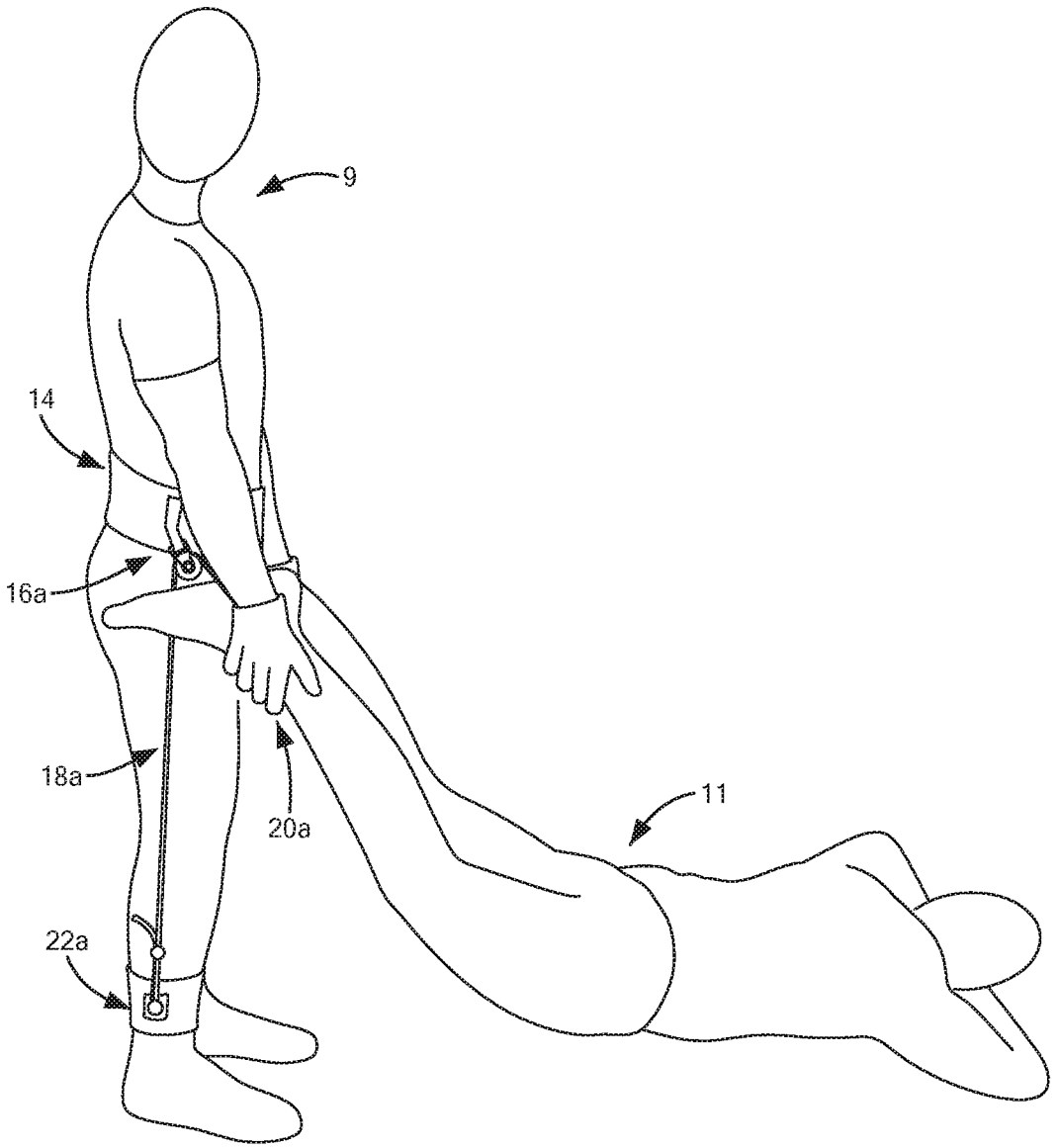
FIG. 5 is a side perspective view of the assistive stretching device of FIG. 2 in a full lift position.

As shown in FIG. 2, the belt 14 is supported around the torso of the user, generally at the waist resting on the hips, or higher if desired. The belt includes a body or strap 13 having first, or outward facing surface 15*a* and a second, or inward facing surface 15*b* (FIG. 1) that is adjacent the user when worn. The first and second pulleys 16*a*, 16*b* are supported on the body 13 on the first surface 15*a* and may be permanently or removably secured thereto, for example by a strap 25 as shown, which may be adjustable and that allow for movement of the pulleys during use. Alternatively, the first and second pulleys 16*a*, 16*b* can be attached to the body 13 in any known manner. The pulleys in the present embodiment are positioned on the body 13 on either side of the user's torso, such that the second pulley 16*b* is sufficiently spaced from the first pulley 16*a* in order that the first cord 18*a* rests adjacent one leg of the user toward an outer side 19*a* thereof, and the second cord 18*b* rests adjacent to the second leg of the user toward an outer side 19*b* thereof, when the user stands vertically as shown in FIGS. 2 and 5. In order to fit a variety of users, the belt is preferably adjustable such that the circumference can be changed, for example by utilizing a mating loop and fastener disposed adjacent opposing ends of the body 13 or a traditional buckle having a prong that fits into an opening in the body 13 of the belt 14, as would be known to those of skill in the art. In addition to the belt being positioned around the torso of the user, the first and a second support attachments 20*a*, 20*b* are also positioned around each of the user's wrists, while the first and second ankle attachments 22*a*, 22*b* are positioned around each of the user's ankles.

As illustrated, like the belt 14, the first and second ankle attachments 22*a*, 22*b* each include a strap 21 having a first, or outward facing surface 23*a* and a second, or inward facing surface 23*b* (FIG. 1) that is placed adjacent the ankle of the user when worn. In order to fit a variety of users, the first and second ankle attachments 22*a*, 22*b* are sized to fit the ankle of the user and may also be adjustable, for example by utilizing a mating loop and fastener, buckle, a circular member that stretches to fit over the foot, but contracts around the ankle, or a strap positioned around the foot between the heel and arch of the user, as would be known to those of skill in the art. In the present embodiment, one end 24*a*, 24*b* of each cord is attached to the corresponding ankle attachment 22*a*, 22*b* by the fastener 28. Fastener 28 is supported on each of the first surfaces 23*a, b* for attachment of corresponding cords 18*a*, 18*b* thereto, with the cords permanently or removably secured to the fasteners 28. The fastener 28 may be any of a variety of fasteners to secure the cord, non-limiting examples including posts, buttons, rings, snaps, clips and the like. As shown in the present embodiment, the fastener 28 is a button with the one end 24*a*, 24*b* of each cord being disposed around the fastener 28 and through a toggle cord lock 29. Toggle cord lock 29 may be of a convention design as known to those of skill in the art, constructed and arranged to secure the cord while allowing adjustment of the length of each cord 18*a*, 18*b*. Similar to the first and second ankle attachments 22*a*, 22*b*, the first and a second support attachments 20*a*, 20*b* are positioned around each of the user's wrists.

As best shown in FIGS. 1 and 2, in the present embodiment the first and a second support attachments 20*a*, 20*b* are shaped like a glove, including a palm 30, fingers 32 and wrist portion 34 and are sized to fit the hand of an average user. The construction of the glove may be such that as the cord is secured to the palm of the glove such that tension is applied to it during the lift, the tension is transmitted to the fingers of the glove providing a closing force to increase the grip or grip strength of the fingers of the user during the lifting of the individual as the user grasps the ankles of the individual. Fingers 32 may be either closed at the top as illustrated, or may be open fingered, so that the top of the user's fingers are not enclosed within the glove. In either case, grip strength of the user will be enhanced. Supported on the inside of each of the glove-shaped attachments 20*a*, 20*b* adjacent the wrist portion 34 is a mounting member 36 designed to attach the opposite end 26*a*, 26*b* of each cord 18*a*, 18*b* to a corresponding support attachment 20*a*, 20*b*. Mounting member 36 may be any of a variety of fasteners to secure the cord, non-limiting examples including a reinforcing material, buttons, rings, snaps, clips and the like. As shown in the present embodiment, the mounting member 36 is a piece of reinforcing material with the opposite end 26*a*, 26*b* of each cord being secured thereto, for example by sewing or other manner. The reinforcing material may be sewn directly to the support attachment 20*a*, 20*b* or may instead include two pieces, one sewn on the support attachment and the other removably secured thereto by hook and loop, or other removable fastening mechanism. It will be understood to those of skill in the art that instead of a glove shape, support attachments 20*a*, 20*b*, like belt 14 the first and second ankle attachments 22*a*, 22*b*, may instead each include a strap secured adjacent the wrist of the user when worn.

Cords 18*a*, 18*b* may be sized according to the height of the user, but should be of sufficient length to work with the first and second pulleys 16*a*, 16*b* in order to change the direction of the input force as the user is lifting the anterior of the individual, as described in greater detail below. The cords 18*a*, 18*b* may be made of any known material that can provide repeated use for lifting a load without much additional friction, for example, paracord, jute, linen, nylon, hemp or similar materials, as would be known to those of skill in the art.

Figure 6:
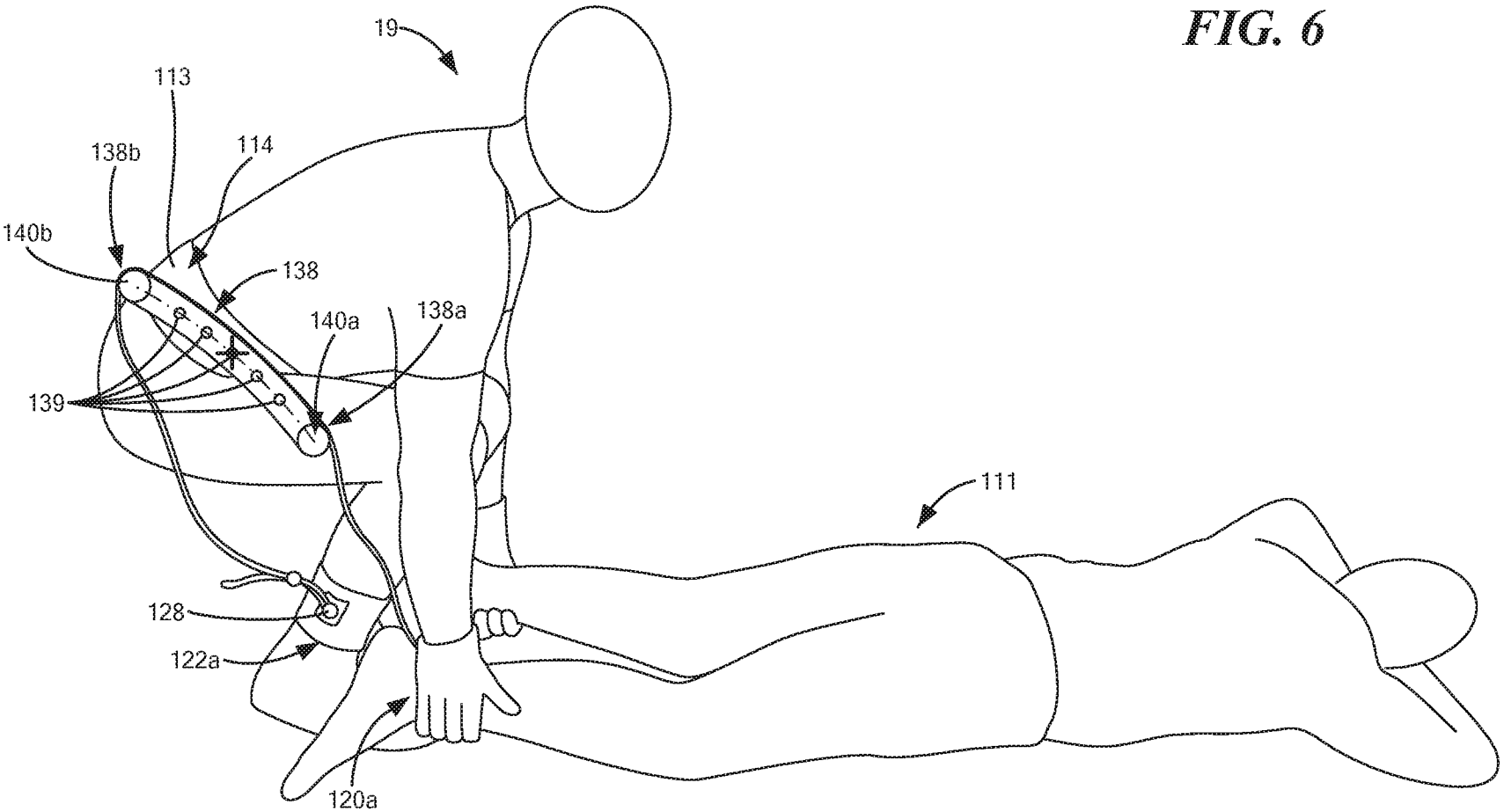
FIG. 6 is a side perspective view of an assistive stretching device in accordance with a second embodiment of the present disclosure in an initial, lifting position.
Figure 7:
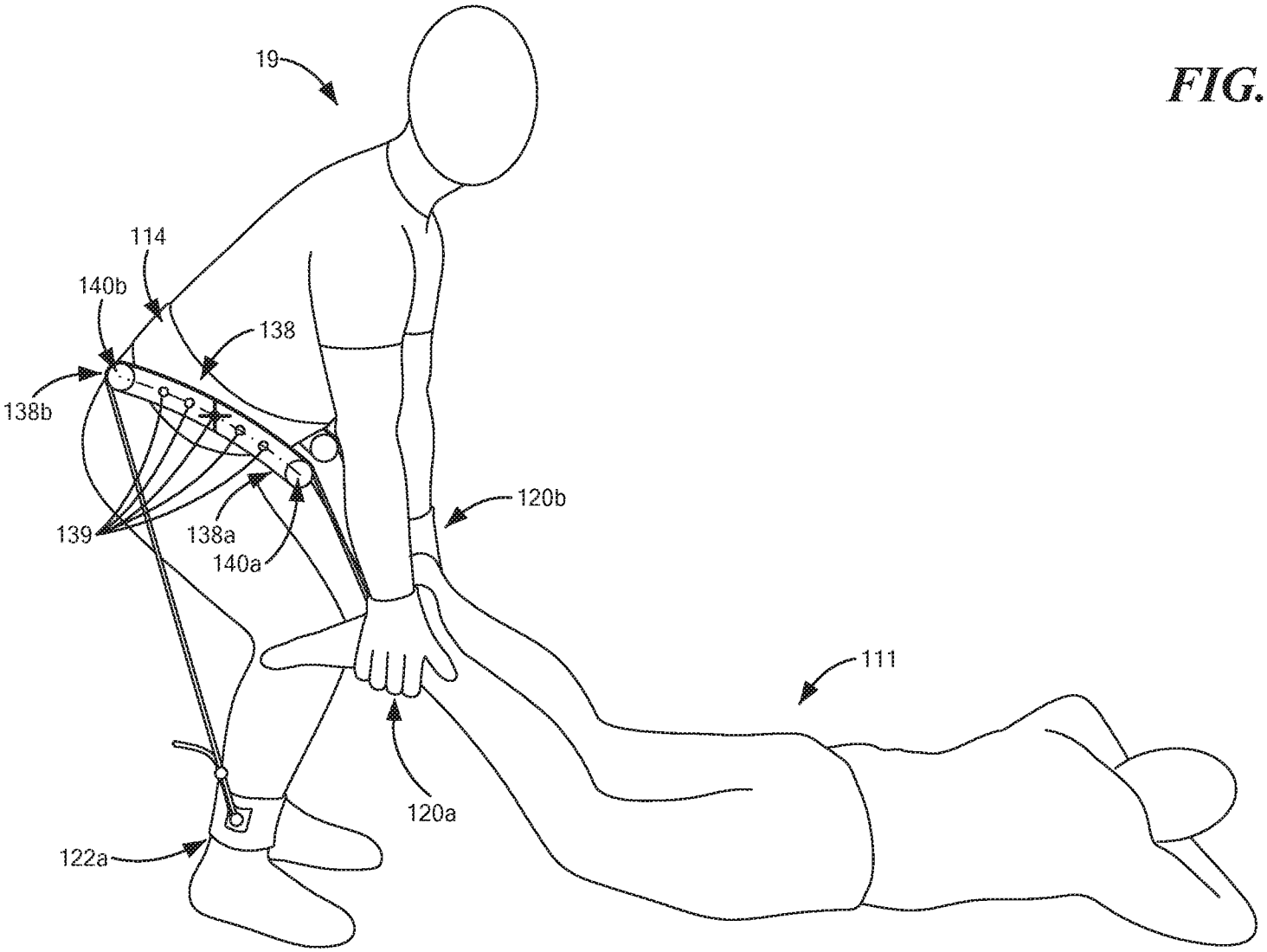
FIG. 7 is a side perspective view of the assistive stretching device of FIG. 6 in a mid-lift position.
Figure 8:
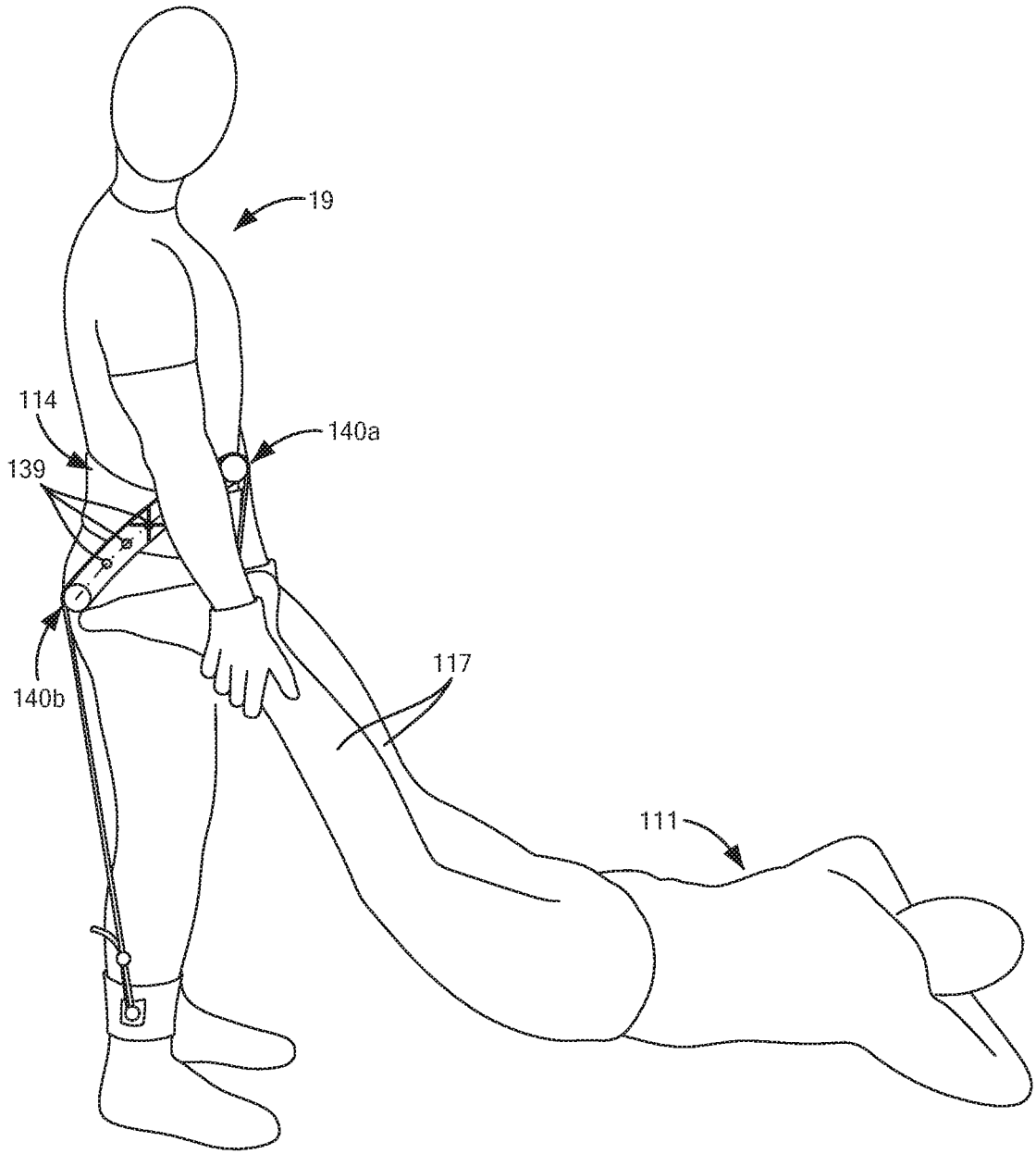
FIG. 8 is a side perspective view of the assistive stretching device of FIG. 6 in a full lift position.

Referring now to FIGS. 6-8, a second embodiment of the assistive stretching device in accordance with the present disclosure is illustrated. In this embodiment, the same or similar elements as the previous embodiment are labeled with the same reference numbers, preceded with the numeral "1" and other elements have a new number but are also preceded by a "1".

As illustrated, instead of a pair of pulleys supported on belt 114, a pair of arms 138 having a first end 138*a* and a second end 138*b* with a length therebetween are supported to the body 113 of belt 114 adjacent either side of the user's torso. A first pulley 140*a* is supported adjacent the first end 138*a* of the arms 138 and a second pulley 140*b* is supported adjacent the second end 138*b* of the arms 138. A plurality of holes 139 are disposed on arms 138 and spaced along their length so that a user can choose which hole 139 to utilize to attach the arms 138 to the belt 114. The length of the cords 118*a*, 118*b* travels through the first pulley 140*a* over the length of arm 138 and through the second pulley 140*b*, down to the ankle attachments 122*a*, 122*b*. As a result, when utilizing the same or similar length cords with the arm 138 of the present embodiment vs. the single pulley mounted to either side of belt 114 in the previous embodiment, a user of a different height 19 can obtain the variable leverage and lift as user 9 (FIGS. 1-5).

Referring now to FIG. 8, as illustrated the first pulley 140*a* is positioned at a greater height than the previous embodiment, the height being adjustable depending upon the hole 139 chosen by the user 19. In the standing position the hands of the user 19 fall naturally by their side as they lift and stretch the anterior aspect of musculature of the individual by grasping the individual's legs 117 in the area near or at the ankles. Since the adjustable arm 138 allows the second pulley 140*b* to be positioned at a greater height than the previous embodiment, the legs of the individual are supported higher than the previous embodiment and increase the stretch to the anterior aspect of the musculature. This operates to reduce physical stress on the user's hands and back as they stretch the anterior aspect of the musculature of the individual 111.

Figure 3:
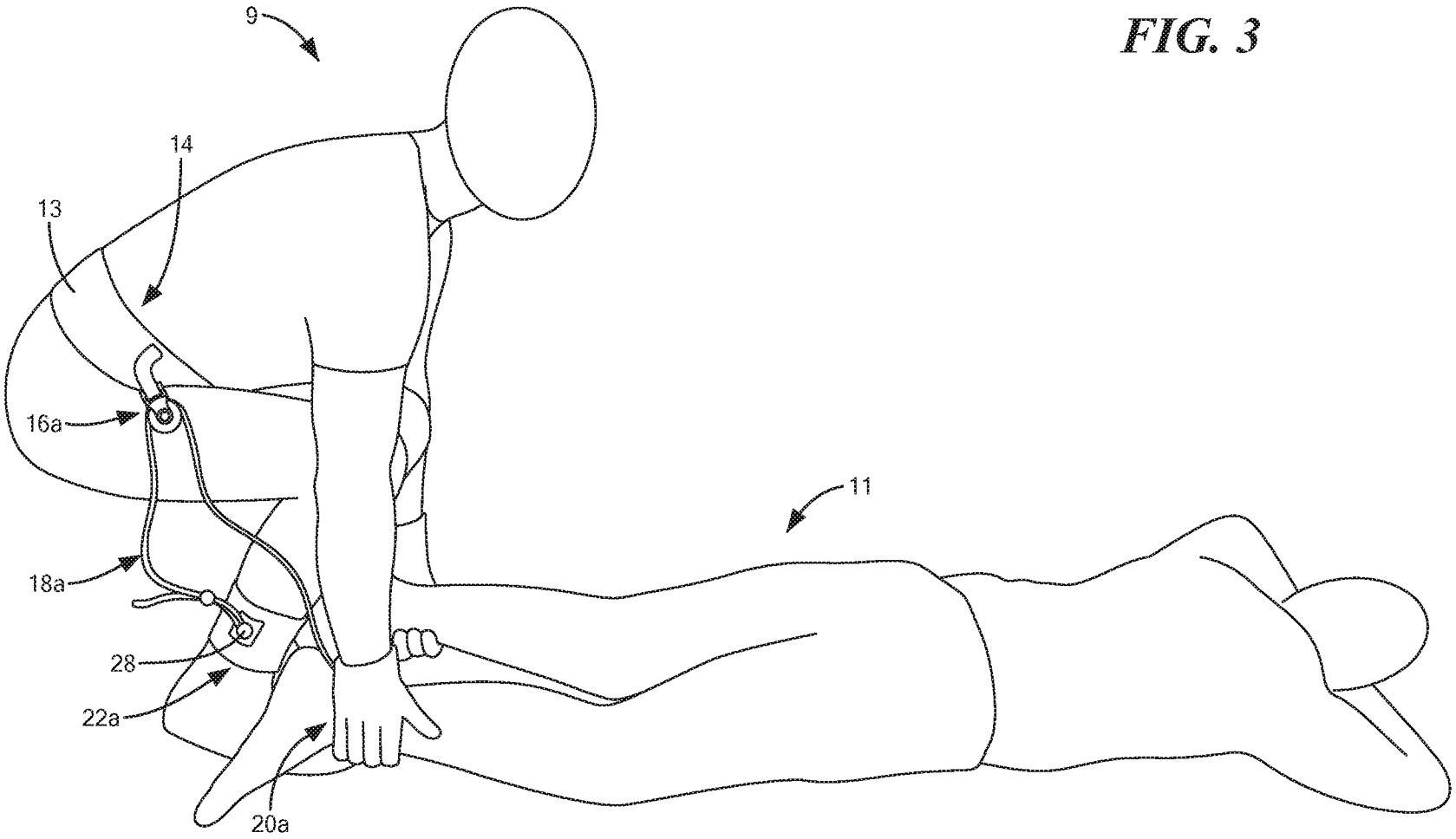
FIG. 3 is a side perspective view of the assistive stretching device of FIG. 2 in an initial, lifting position.
Figure 4:
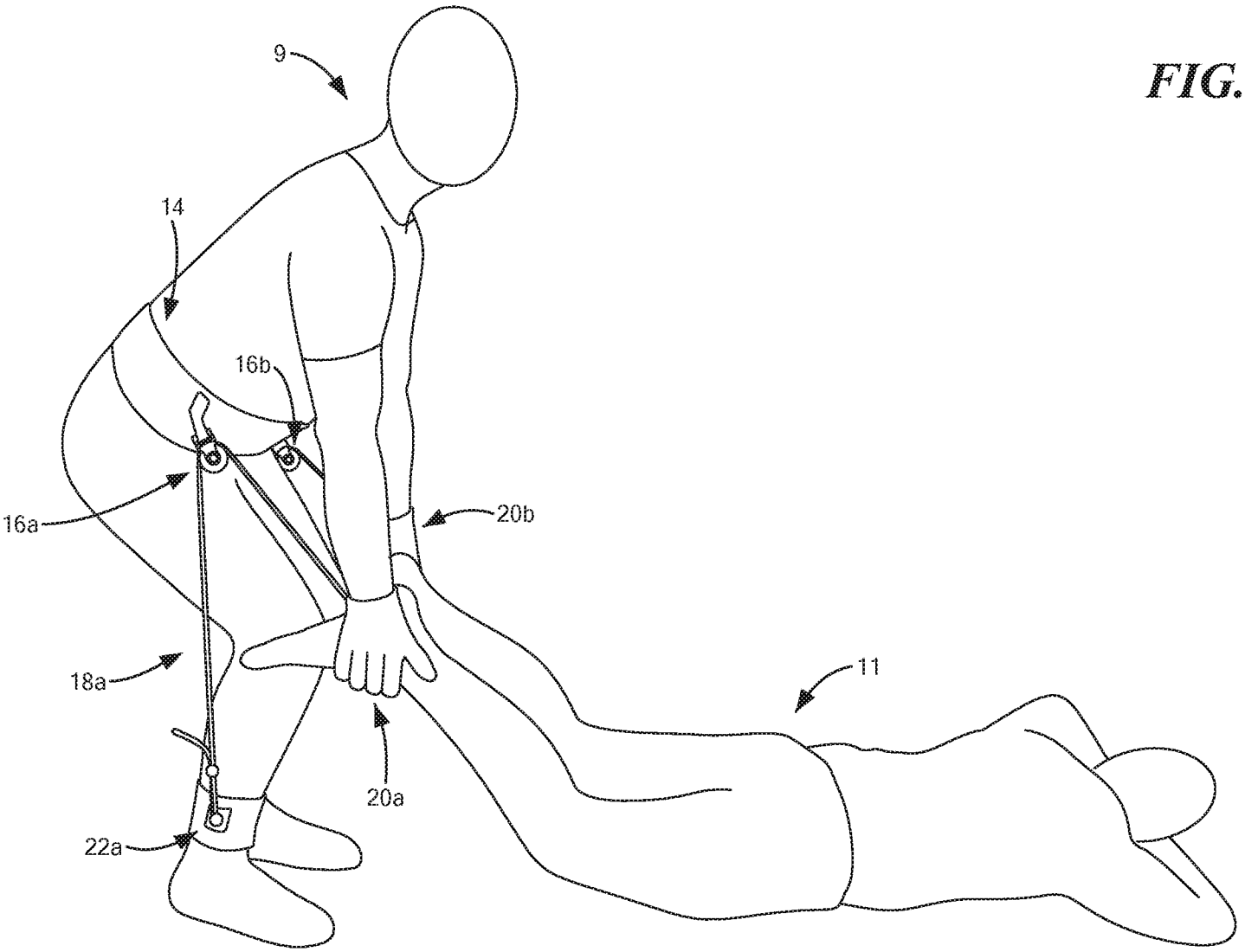
FIG. 4 is a side perspective view of the assistive stretching device of FIG. 2 in a mid-lift position.

Referring to FIGS. 2-5 in conjunction with FIGS. 6-8, the method of using the assistive lifting device will now be described. According to methods of use disclosed herein, and for purposes of illustration regarding the functions of the elements of the device, the individual to be stretched is situated in a prone position with feet spread-apart to a distance approximately the width of the hip of the individual. FIG. 2 shows the user 9 outfitted in one embodiment of the device, prior to stretching of the individual 11. FIGS. 3 and 6 show the individual 11, 111 in a prone position with the user 9, 19 grasping the individual's legs 17, 117, in the area near or at the ankles, prior to stretching the individual's anterior muscles. In order to obtain the beneficial stretching assisted by device, after the user 9, 19 grasps the ankles of the individual 11, 111, the user begins to stand moving into an intermediate position, as shown in FIGS. 4 and 7. As the user 9, 19 stands, the height of the lower extremities of the individual 11, 111 are increased with respect to the plane upon which the individual is lying. In this way, the individual is placed in a position that facilitates stretching of the anterior muscles and ligaments. In this stretch, it is desirable to raise the individual's feet off of the ground by at least 3 inches. The elevation height of the individual's feet from the plane can vary from 3 inches to over 40 inches depending on the desired stretch intensity and height of the individual.

FIGS. 5 & 8 depict the stretch with the user 9, 19 in the full standing position, however the intermediate position with the user squatting and only partially lifting the legs of the individual is also to be considered a full stretch, depending upon the desired amount of stretch for the particular individual's needs. In preferred methods of use, the individual's upper chest, arms, and head remain on the surface upon which the individual is laying. However, it may be desirable to rotate onto their side or back to provide a stretch that varies on alternate sides of the anterior muscles. For example, some individuals may be tighter on the left side of their anterior muscles. Similarly, the user could also increase the height of one foot with respect to another, in order to create a bias to stretch one anterior quadrant preferentially over the other. This is accomplished by lifting adjusting the lifting straps longer or shorter to lift one leg higher or lower than the other to address disparities in muscle, fascia, or ligament tightness.

Those of skill in the art will recognize throughout this specification that when like terms are used to describe features and functionalities of various portions of a particular embodiment, those same features and functionalities could be present in additional embodiments having aspects with like terms.

Those skilled in the art will also appreciate that the conception, upon which this disclosure is based, may readily be utilized as a basis for designing other products without departing from the spirit and scope of the invention as defined by the appended claims. Therefore, the claims are not to be limited to the specific examples depicted herein. For example, the features of one example disclosed above can be used with the features of another example. Furthermore, various modifications and rearrangements of the parts may be made without departing from the spirit and scope of the underlying inventive concept. For example, the geometric configurations, size and positioning disclosed herein for the harness, belt, attachment members and cords may be readily altered depending upon the application, as may the material selection for the components. Thus, the details of these components as set forth in the above-described examples, should not limit the scope of the claims.

Further, the purpose of the Abstract is to enable the U. S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the claims of the application nor is intended to be limiting on the claims in any way.

What is claimed is:

1. An assistive stretching device utilized during a stretching exercise performed by a user with another individual, the assistive stretching device comprising:

a belt constructed and arranged to fit around the torso of the user and including body having a first end and an opposing second end, a first, outward facing surface and a second, inward facing surface;

at least a first pulley supported by the belt and a second pulley spaced from the first pulley and supported by the belt;

a first and a second support attachment constructed and arranged to fit one of each of the user's wrists;

a first and a second ankle attachment constructed and arranged to fit one of each of the user's ankles;

a first cord threaded through the first pulley and having one end attached to one of the ankle attachments and an opposite end attached to one of the support attachments and defining a length therebetween;

a second cord threaded through the second pulley and having one end attached to one of the ankle attachments and an opposite end attached to one of the support attachments and defining a length therebetween;

wherein when the user is in a substantially vertical position, the first and second pulleys operating to reduce physical stress on the user as the user stretches anterior musculature of the individual.

2. The assistive stretching device of claim 1, wherein the spacing between the first pulley and the second pulley is sized in order that the first cord is positioned adjacent one leg of the user toward an outer side thereof, and the second cord is positioned adjacent to a second leg of the user toward an outer side thereof during use.

3. The assistive stretching device of claim 1, wherein the first and second cords each have an adjustable length.

4. The assistive stretching device of claim 1, wherein the belt is adjustable such that the circumference can be changed to fit a waist of the user.

5. The assistive stretching device of claim 1, wherein the first and second support attachments are glove shaped including a palm, fingers, and wrist portion.

6. The assistive stretching device of claim 5, wherein the opposite end of the first and second cords are secured to the palm of the corresponding glove shaped support attachments.

7. The assistive stretching device of claim 6, wherein during use tension is applied to the palm of the glove shaped support attachments as the user grasps and lifts the individual, the tension from the palm being transmitted to the fingers of the glove shaped support attachments so as to provide a closing force to increase the grip strength of the fingers of the user as the user grasps the ankles of the individual.

8. The assistive stretching device of claim 1, wherein the first and second ankle attachments each include a fastener constructed and arranged to attach the corresponding one end of the first and second cords.

9. The assistive stretching device of claim 8, wherein the first and second cord are disposed around the corresponding fastener and each further include a toggle cord lock constructed and arranged to secure the cord while allowing adjustment of the length in the cord.

10. The assistive stretching device of claim 1, wherein the at least first pulley and second pulley comprise a first pulley and a second pulley, each of the first and second pulley supported on the belt by a pulley strap.

11. The assistive stretching device of claim 10, wherein the pulley strap is adjustable.

12. The assistive stretching device of claim 10, wherein the first and second pulleys are each removably secured to the belt by one or more pulley straps.

13. An assistive stretching device utilized during a stretching exercise performed by a user with another individual, the assistive stretching device comprising:

a belt constructed and arranged to fit around the torso of the user and including body having a first end and an opposing second end, a first, outward facing surface and a second, inward facing surface;

at least a first pair of pulleys supported by the belt and a second pair of pulleys spaced from the first pair of pulleys and supported by the belt;

a pair of arms each having a first end and a second end with a length therebetween constructed and arranged to be supported on the body of the belt, each arm including a plurality of holes disposed therein and spaced along the length, the holes being configured and arranged to secure the arm to the belt;

a first and a second support attachment constructed and arranged to fit one of each of the user's wrists;

a first and a second ankle attachment constructed and arranged to fit one of each of the user's ankles;

a first cord threaded through the first pair of pulleys and having one end attached to one of the ankle attachments and an opposite end attached to one of the support attachments and defining a length therebetween;

a second cord threaded through the second pair of pulleys and having one end attached to one of the ankle attachments and an opposite end attached to one of the support attachments and defining a length therebetween;

wherein when the user is in a substantially vertical position, the first and second pulleys operating to reduce physical stress on the user as the user stretches anterior musculature of the individual.

14. The assistive stretching device of claim 13, wherein the length of the first cord is sized to travel through the first pair of pulleys and over the length of the arm and the length of the second cord is sized to travel through the second pair of pulleys and over the length of the arm.

15. The assistive stretching device of claim 13, wherein the at least first pair of pulleys comprise a first pulley supported adjacent the first end of the first arm and a second pulley supported adjacent the second end of the first arm, and the at least second pair of pulleys comprise a first pulley supported adjacent the first end of the second arm and a second pulley supported adjacent the second end the second arm.

16. A method of stretching an individual in a prone position by a user comprising the steps of:

providing a harness including:

a) a belt constructed and arranged to fit around the waist of the user and supporting a first pulley system and a second pulley system spaced from the first pulley, the first and second pulley systems each including a pulley and a cord threaded through the pulley;

b) at least a first and a second wrist attachment constructed and arranged to be secured to each of the user's wrists so as to improve the grip strength of the user, and wherein one end of each of the cords is attached to one of the first and second wrist attachments;

c) at least a first and a second ankle attachment constructed and arranged to be secured to each of the user's ankles and wherein an opposite end of each of the cords is attached to one of the first and second ankle attachments;

standing, by the user, near the feet of the individual to be stretched so that the feet of the individual are within reach of the user;

holding, by the user, the legs of the individual being stretched, one leg of the individual in each hand of the user; and lifting, by the user, at least one leg of the individual being stretched at least three inches off the flat surface to stretch anterior musculature of the individual.

* * * * *